US010329802B1

(12) United States Patent
Huang

(10) Patent No.: US 10,329,802 B1
(45) Date of Patent: Jun. 25, 2019

(54) LOCK MECHANISM

(71) Applicant: TAIWAN FU HSING INDUSTRIAL CO., LTD., Kaohsiung (TW)

(72) Inventor: Chao-Ming Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 15/959,361

(22) Filed: Apr. 23, 2018

(30) Foreign Application Priority Data

Mar. 5, 2018 (TW) ..... 107202876 U

(51) Int. Cl.
*E05B 17/04* (2006.01)
*E05B 63/00* (2006.01)

(52) U.S. Cl.
CPC ..... *E05B 63/006* (2013.01); *E05B 63/0017* (2013.01); *E05B 17/04* (2013.01); *E05B 17/041* (2013.01)

(58) Field of Classification Search
CPC .... E05B 63/006; E05B 63/0017; E05B 17/04; E05B 17/041; E05B 17/004; E05B 5/003
USPC ..... 70/79 R, 380, 461
See application file for complete search history.

(56) References Cited

U.S. PATENT DOCUMENTS 1,843,143 A * 2/1932 Rymer ..... E05B 55/005 70/370
3,702,549 A * 11/1972 Solovieff ..... E05B 15/0086 292/139
4,052,092 A * 10/1977 Bergen ..... E05C 1/14 292/1.5
4,671,089 A * 6/1987 Fleming ..... E05B 3/065 70/422
4,725,085 A * 2/1988 Hu ..... E05B 55/00 292/1.5
6,145,358 A * 11/2000 Wu ..... E05B 13/004 70/381
6,178,794 B1 * 1/2001 Eller ..... E05B 13/005 292/DIG. 27
6,178,795 B1 * 1/2001 Hsueh ..... E05B 13/005 292/172
2003/0019257 A1 * 1/2003 Simon ..... E05B 55/005 70/224
2003/0071471 A1 * 4/2003 Lu ..... E05B 47/0012 292/144

(Continued)

FOREIGN PATENT DOCUMENTS

CN 101405466 B 8/2015

*Primary Examiner* — Suzanne L Barrett
(74) *Attorney, Agent, or Firm* — Jackson IPG PLLC; Demian K. Jackson

(57) ABSTRACT

A lock mechanism includes a plug assembly, a transmission spindle, a bush and a latchbolt assembly. The transmission spindle is coupled to the plug assembly. The bush and the transmission spindle are coupled as one piece to allow the transmission spindle to drive the bush rotate. The latchbolt assembly includes a latchbolt and an actuation element having an actuation hole. The bush, movably accommodated in the actuation hole, is provided to drive the actuation element in swinging movement to move the latchbolt. Because of the bush movably accommodated in the actuation hole, the latchbolt assembly can move toward or away from the plug assembly and the lock mechanism can be mounted on doors having different thicknesses.

10 Claims, 8 Drawing Sheets

(56) References Cited

U.S. PATENT DOCUMENTS

| | | | | |
|---|---|---|---|---|
| 2003/0230903 | A1* | 12/2003 | Huang | E05B 63/06 292/337 |
| 2005/0172685 | A1* | 8/2005 | Keightly | E05B 47/0012 70/279.1 |
| 2014/0238180 | A1* | 8/2014 | Huang | E05B 63/006 74/503 |
| 2018/0328077 | A1* | 11/2018 | Huang | E05C 7/02 |

* cited by examiner

LOCK MECHANISM

FIELD OF THE INVENTION

This invention relates to a lock mechanism, and more particularly relates to a lock mechanism able to be mounted on doors having different thicknesses.

BACKGROUND OF THE INVENTION

China patent application No. 200780010321.8 discloses a low profile deadbolt assembly 10. The deadbolt assembly 10 includes a keyed low profile actuator assembly 24, a deadbolt latch assembly 26, a crank 84 and an interior actuator assembly 28 which are mounted on a door 12 sequentially. According to FIGS. 1 and 4 of CN 200780010321.8, the crank 84 is installed on a lateral side of the deadbolt latch assembly 26 so the width including the crank 84 and the deadbolt latch assembly 26 may lead the deadbolt assembly 10 can't be mounted on a thin door.

Otherwise, pins in conventional deadbolt lock usually have a fixed sum because of the standard profile of commercial cylinder, that is to say the cylinder has a fixed length and has size limitation when assembled with a latch assembly. As a result, a convex portion on an escutcheon is required for accommodating the protruded cylinder and the conventional deadbolt lock has visual defects of insufficient flatness and appearance.

SUMMARY

The object of the present invention is to provide a lock mechanism. A transmission spindle is provided to couple with a bush which is accommodated in an actuation hole of an actuation element of a latchbolt assembly. As a result, the lock mechanism can be mounted on doors having different thicknesses and has the visual advantage of flatness because the latchbolt assembly can be moved away from or toward a plug assembly.

The lock mechanism of the present invention includes a plug assembly, a transmission spindle, a bush and a latchbolt assembly. The plug assembly includes a plug which has a first coupling end portion. The transmission spindle includes a transmission portion and a second coupling end portion which is coupled with the first coupling end portion such that the plug can drive the transmission spindle rotate. The bush covers the first and second coupling end portions, and the bush and the transmission spindle are coupled with each other and rotate together. The latchbolt assembly includes a latchbolt and an actuation element having an actuation hole. The bush is movably accommodated in the actuation hole and provided to move the actuation element in swinging movement to move the latchbolt.

In the lock mechanism of the present invention, the bush is coupled to the transmission spindle and movably accommodated in the actuation hole of the actuation element of the plug assembly such that the distance between the latchbolt assembly and the plug assembly is adjustable. For this reason, the lock mechanism can be mounted on doors having different thicknesses and can prevent the first coupling end portion of the plug from blocking the latchbolt assembly so the lock mechanism can be applied in a thinner door.

DETAILED DESCRIPTION OF THE INVENTION

Figure 1:
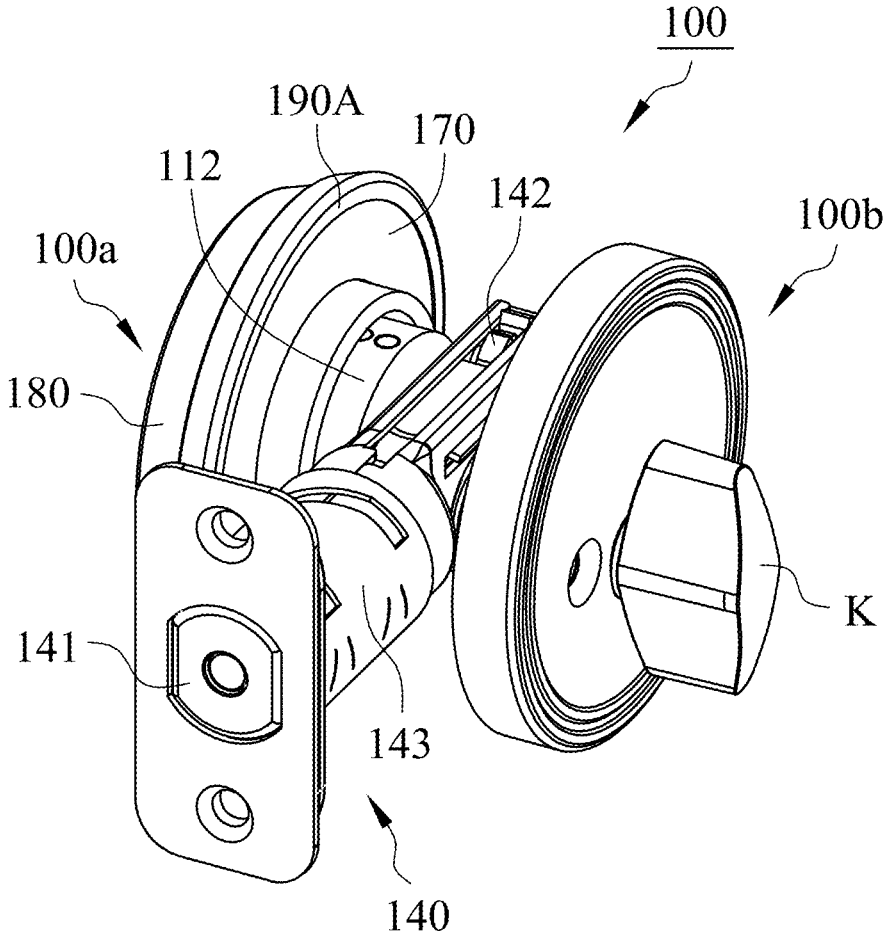
FIG. 1 is a perspective assembly diagram illustrating a lock mechanism in accordance with a first embodiment of the present invention.
Figure 2:
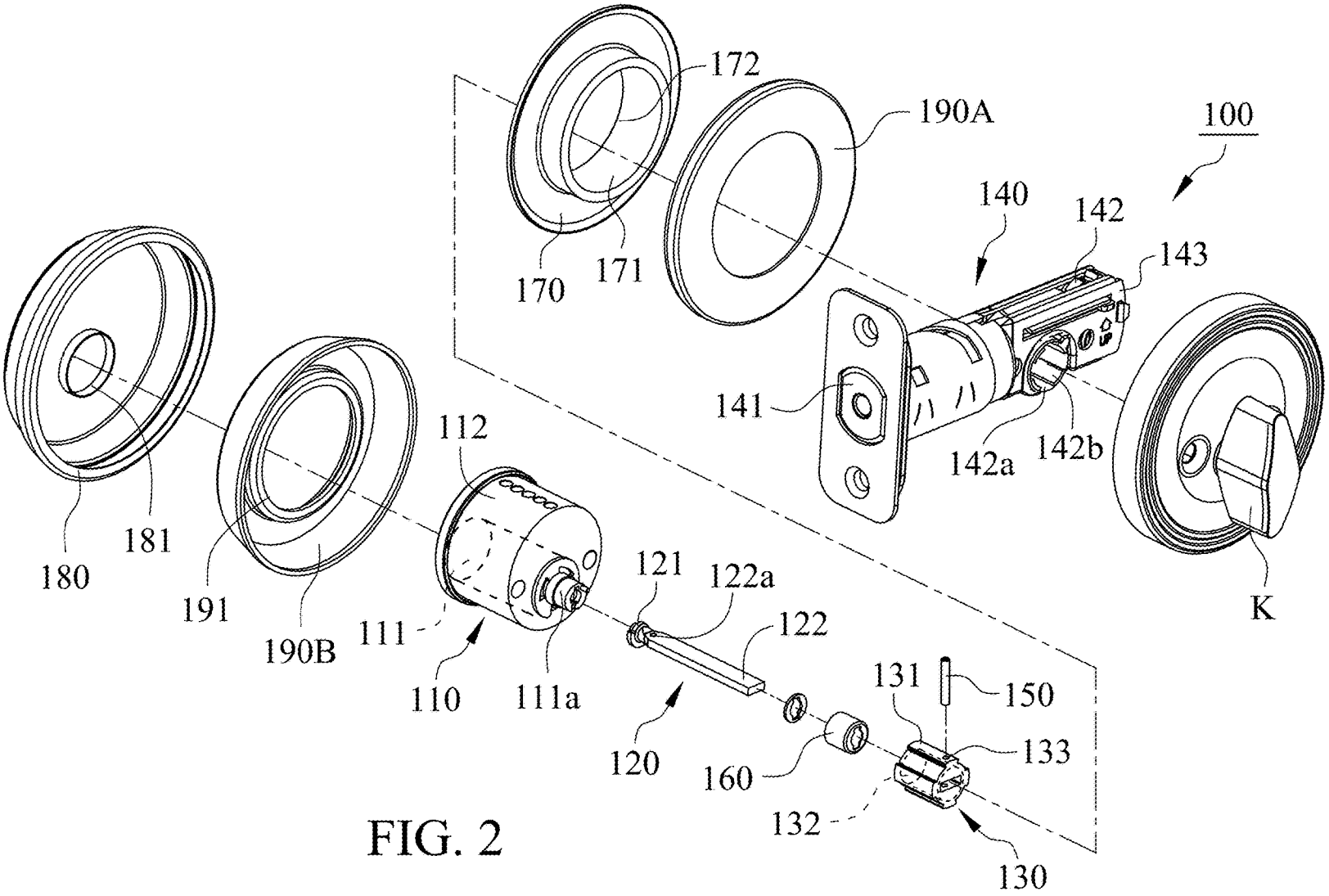
FIG. 2 is a perspective exploded diagram illustrating the lock mechanism in accordance with the first embodiment of the present invention.

With reference to FIGS. 1 and 2, a lock mechanism 100 of a first embodiment of the present invention includes an exterior actuation assembly 100*a* and an interior actuation assembly 100*b* which are mounted on two sides of a door (not shown), respectively. And the exterior and interior actuation assemblies 100*a* and 100*b* are provided to actuate a latchbolt assembly 140, respectively, to lock or unlock the door.

With reference to FIGS. 1 and 2, the lock mechanism 100 includes a plug assembly 110, a transmission spindle 120, a bush 130 and a latchbolt assembly 140. The plug assembly 110 includes a plug 111, a cylinder 112 and a plurality of pins (not shown), and the plug 111 and the pins are disposed in the cylinder 112. The plug 111 has a first coupling end portion 111*a* that is protruded from the cylinder 112.

Figure 3:
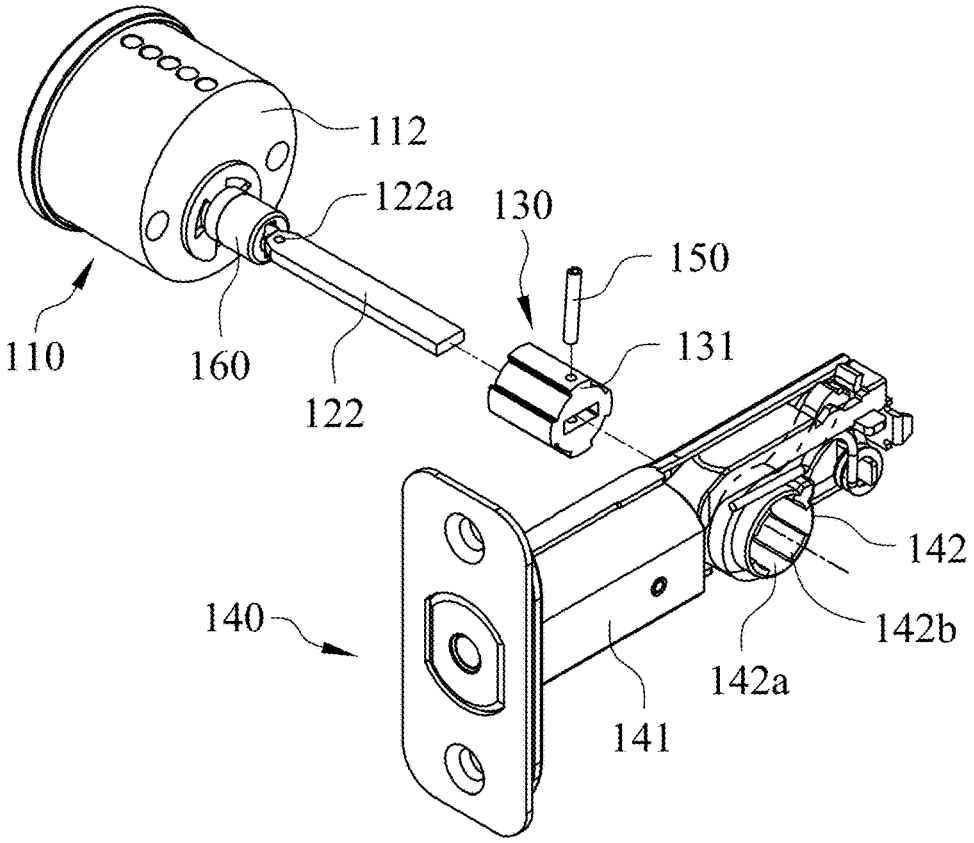
FIG. 3 is a perspective exploded diagram illustrating a part of the lock mechanism in accordance with the first embodiment of the present invention.
Figure 6:
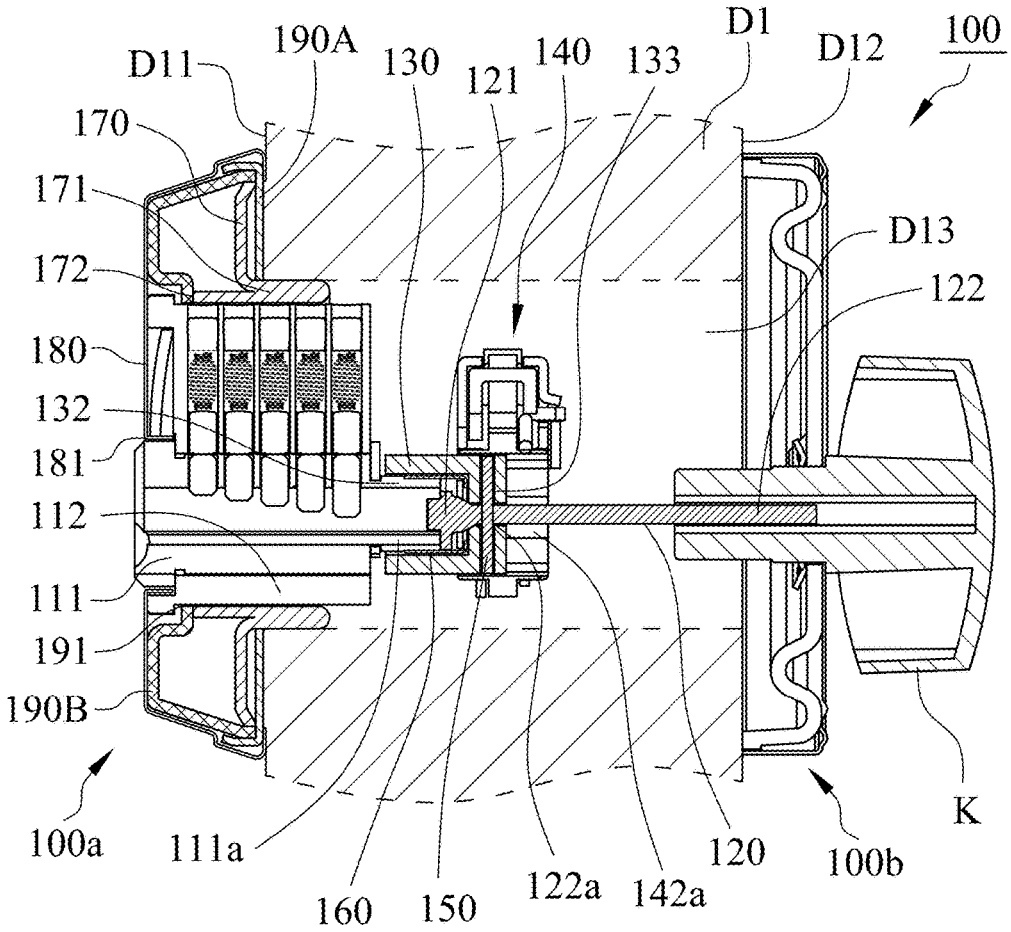
FIG. 6 is a cross-section view diagram illustrating the lock mechanism in accordance with the first embodiment of the present invention.

With reference to FIG. 2, the transmission spindle 120 includes a second coupling end portion 121 and a transmission portion 122 which are connected as one piece in this embodiment. With reference to FIGS. 2 and 6, the second coupling end portion 121 of the transmission spindle 120 is coupled to the first coupling end portion 111*a* of the plug 111. When user uses a key (not shown) to rotate the plug 111, the plug 111 can drive the transmission spindle 120 to rotate. With reference to FIGS. 2, 3 and 6, the lock mechanism 100 preferably further includes a cover 160 covering the first coupling end portion 111*a* and the second coupling end portion 121. The cover 160 is coupled with the first coupling end portion 111*a* to prevent the transmission spindle 120 from separating from the first coupling end portion 111*a* of the plug 111.

Figure 5:
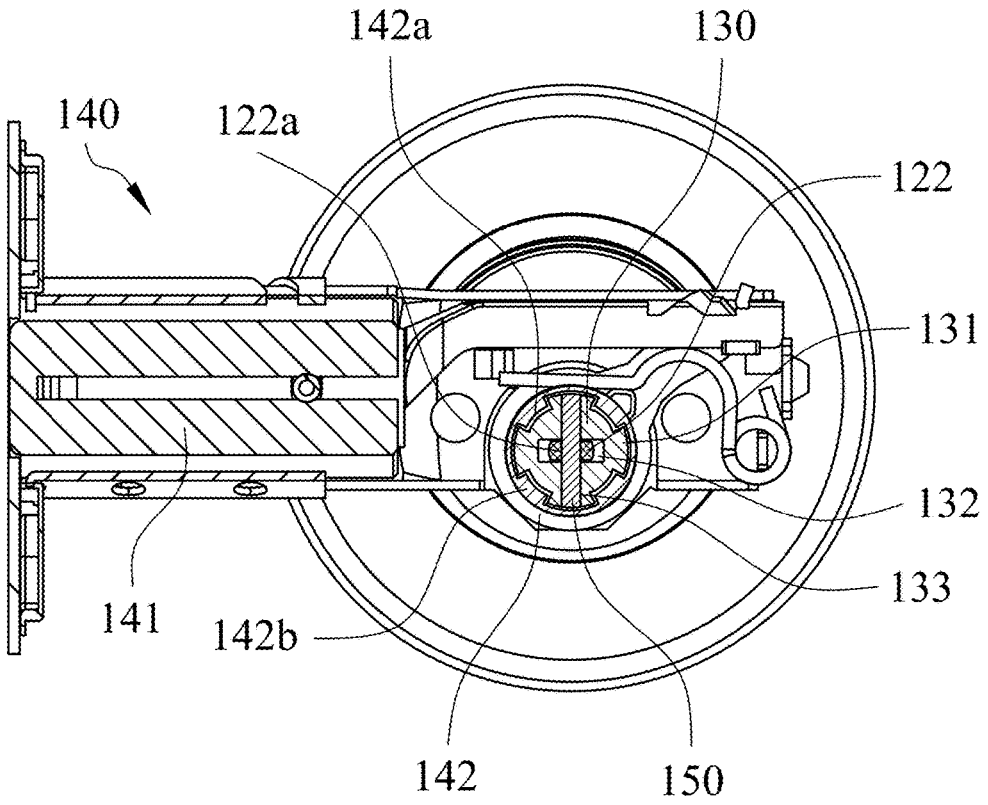
FIG. 5 is a cross-section view diagram illustrating the lock mechanism in accordance with the first embodiment of the present invention.

With reference to FIGS. 2, 5 and 6, the bush 130 and the transmission spindle 120 are coupled with each other so they can rotate together. In this embodiment, the lock mechanism 100 further includes a coupling element 150, the bush 130 has a horizontal through hole 132 and a vertical through hole 133 which is communicated with the horizontal through hole 132, and the transmission portion 122 has a coupling hole 122*a*. In order to couple the bush 130 and the transmission spindle 120 as one piece, the transmission portion 122 is assembled through the horizontal through hole 132 of the bush 130 and the coupling element 150 is assembled through the vertical through hole 133 and the coupling hole 122*a*.

With reference to FIGS. 3 and 6, the first coupling end portion 111*a* and the second coupling end portion 121 are covered by the bush 130 and accommodated in the horizontal through hole 132 of the bush 130. In this embodiment, the cover 160 is also accommodated in the horizontal through hole 132 of the bush 130.

Figure 4:
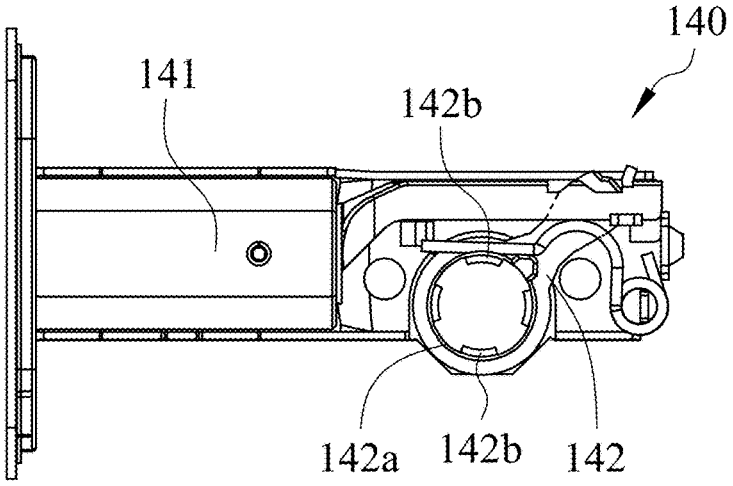
FIG. 4 is a lateral view diagram illustrating a latchbolt assembly (without housing) of the lock mechanism in accordance with the first embodiment of the present invention.

With reference to FIGS. 2, 3 and 4, the latchbolt assembly 140 includes a latchbolt 141, an actuation element 142 and a housing 143. The latchbolt 141 and the actuation element 142 are disposed in the housing 143, and the actuation element 142 is adapted to drive the latchbolt 141 protrude from or retract into the housing 143.

With reference to FIGS. 2, 3, 4 and 5, the bush 130 is movably accommodated within an actuation hole 142*a* of the actuation element 142, and preferably, the bush 130 and the actuation hole 142*a* are engaged with each other. The bush 130 is provided to move the actuation portion 142 in swinging movement to actuate operation of the latchbolt 141. With reference to FIG. 6, in this embodiment, the transmission portion 122 is inserted into the bush 130 through the horizontal through hole 132 and protruded from the actuation hole 142*a* of the actuation element 142. The transmission portion 122 protruding from the actuation hole 142*a* is coupled to a knob K of the lock mechanism 100 such that the transmission portion 122 and the knob K can rotate together. When rotating the knob K or the plug 111, the knob K or the plug 111 can drive the transmission spindle 120 rotate, the transmission spindle 120 in rotation can drive the bush 130 rotate and then the bush 130 in rotation can drive the actuation element 142 swing to move the latchbolt 141 protrude from or retract into the housing 143.

With reference to FIGS. 2, 3, 4 and 5, the bush 130 includes at least one actuation convex 131 and the actuation element 142 includes at least one pushed convex 142*b* in the actuation hole 142*a* in this embodiment. The actuation convex 131 is designed to push the pushed convex 142*b*. When the bush 130 is driven to rotate by the transmission spindle 120, the actuation convex 131 can push the pushed convex 142*b* to move the actuation element 142 in swinging movement, as a result, the actuation element 142 can move the latchbolt 141 protrude from or retract into the housing 143.

Figure 8:
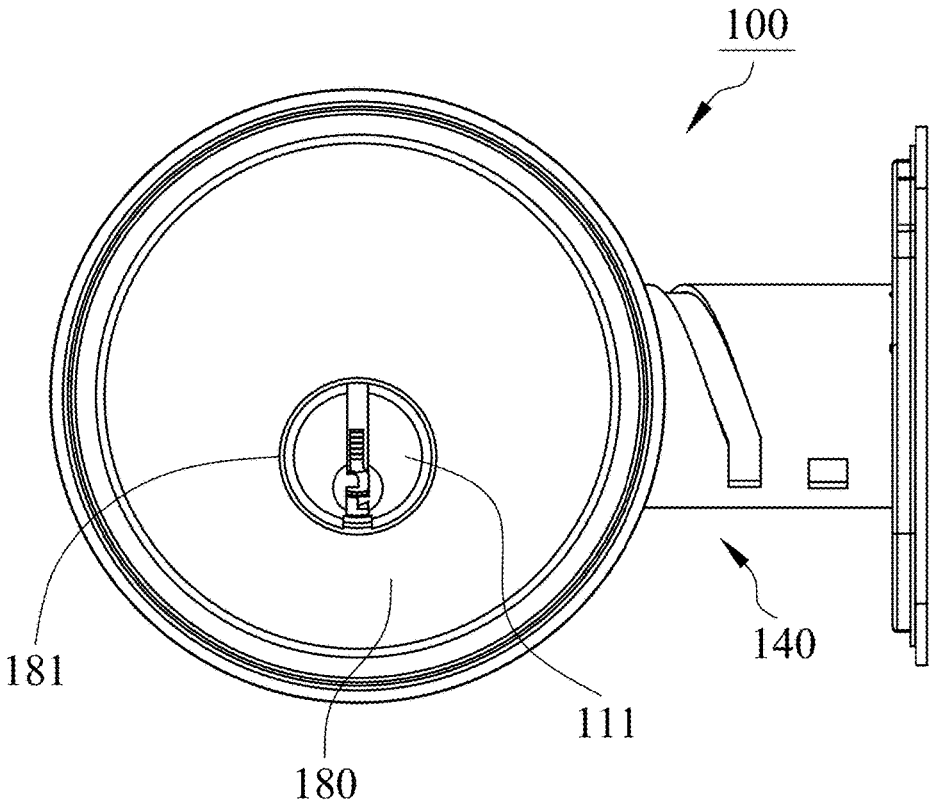
FIG. 8 is a lateral view diagram illustrating the lock mechanism in accordance with the first embodiment of the present invention.

With reference to FIGS. 2, 6 and 8, the lock mechanism 100 further includes a fixing plate 170 having a fixing base 171 and a first escutcheon 180 having a first opening 181. The plug assembly 110 is installed in the fixing base 171 and the cylinder 112 is installed in a through hole 172 of the fixing base 171. The first escutcheon 180 is used to cover the fixing plate 170 and the cylinder 112, and the first opening 181 reveals the plug 111. Preferably, the lock mechanism 100 further includes an interior lid 190A and a second escutcheon 190B. The second escutcheon 190B, which is located between the first escutcheon 180 and the fixing plate 170, is provided to cover the fixing plate 170. The interior lid 190A is provided to cover and rivet with the second escutcheon 190B, and the fixing plate 170 is located between the interior lid 190A and the second escutcheon 190B so can improve the mechanical strength of the lock mechanism 100 and prevent the damage of the lock mechanism 100 caused by knock. The second escutcheon 190B has a second opening 191 revealing the cylinder 112 and the plug 111. In this embodiment, the first escutcheon 180 covers the second escutcheon 190B and the cylinder 112 and only reveals the plug 111.

Figure 7:
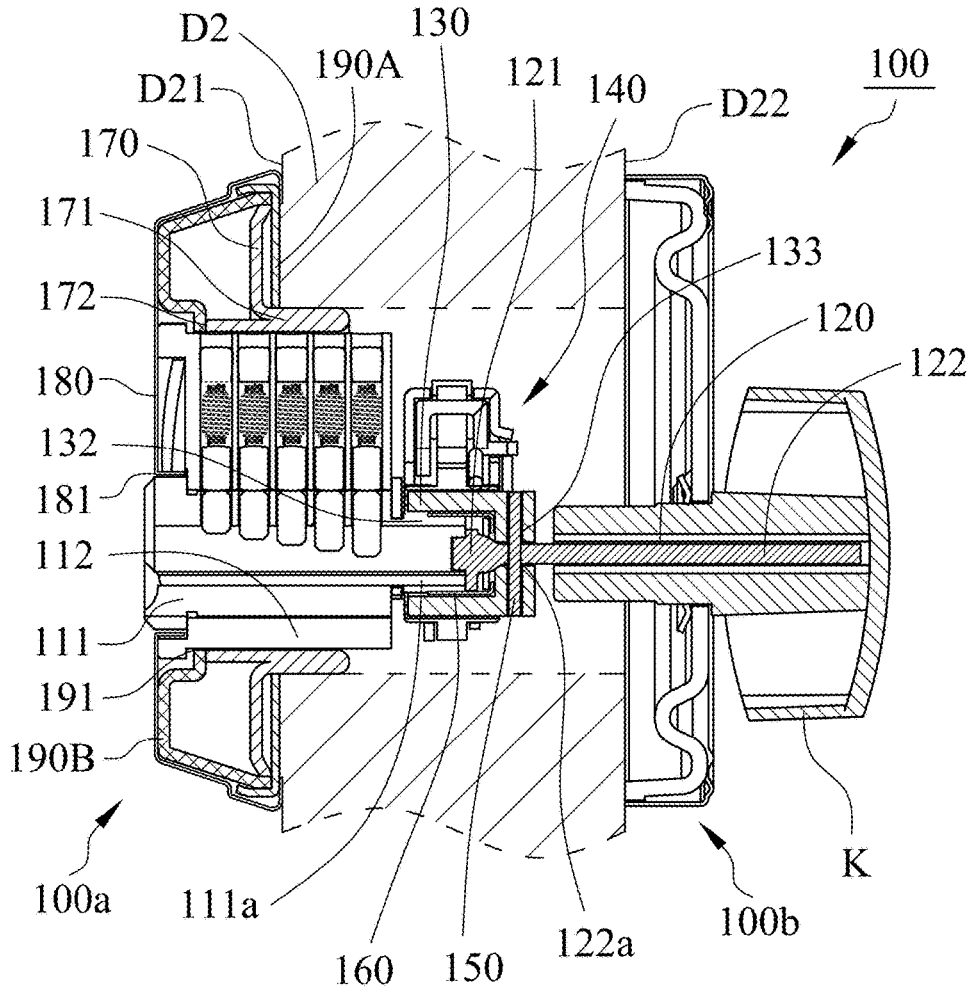
FIG. 7 is a cross-section view diagram illustrating the lock mechanism in accordance with the first embodiment of the present invention.

With reference to FIGS. 6 and 7, the cross-section view drawings represent the lock mechanism 100 mounted on a door D1 and a door D2 having different thicknesses, and the door D1 is thicker than the door D2. With reference to FIGS. 1 and 6, the lock mechanism 100 is mounted on the thicker door D1, and the exterior actuation assembly 100*a* and the interior actuation assembly 100*b* are mounted on a first lateral side D11 and a second lateral side D12 of the door D1, respectively. The first coupling end portion 111*a* of the plug 111, the transmission spindle 120, the bush 130 and the latchbolt assembly 140 are located in a through hole D13 that communicates the first lateral side D11 and the second lateral side D12. With reference to FIG. 6, the bush 130 is located at a first position in the actuation hole 142*a*. With reference to FIGS. 5 and 6, the transmission spindle 120 is driven to rotate by the plug 111 or the knob K in rotation, then the transmission spindle 120 in rotation can drive the bush 130 rotate and the bush 130 in rotation can push the actuation element 142 in swinging movement to move the latchbolt 141 protruding from or retracting into the housing 143.

With reference to FIGS. 6 and 7, owing to the bush 130 is accommodated in the actuation hole 142*a* and the first coupling end portion 111*a* and the second coupling end portion 121 are accommodated in the bush 130, the first coupling end portion 111*a* of the plug 111 will not block the latchbolt assembly 140 when the lock mechanism 100 is mounted on the thinner door D2. The latchbolt assembly 140 can move toward the cylinder 112 of the plug assembly 110 and the bush 130 can move from the first position (shown as FIG. 6) to a second position (shown as FIG. 7) in the actuation hole 142*a* to change the distance between the latchbolt assembly 140 and the plug assembly 110. Accordingly, the exterior actuation assembly 100*a* and the interior actuation assembly 100*b* can be mounted on a first lateral side D21 and a second lateral side D22 of the door D2, respectively.

With reference to FIGS. 6 and 7, owing to the bush 130 coupling with the transmission spindle 120 is movably accommodated in the actuation hole 142*a* of the actuation element 142, the latchbolt assembly 140 can move close toward the plug assembly 110 without the blocking of the first coupling end portion 111*a* of the plug 111 between the cylinder 112 and the latchbolt assembly 140. The lock mechanism 100 can be mounted on doors having different thicknesses, especially a thin door, and has visual advantage of flatness.

Figure 9:
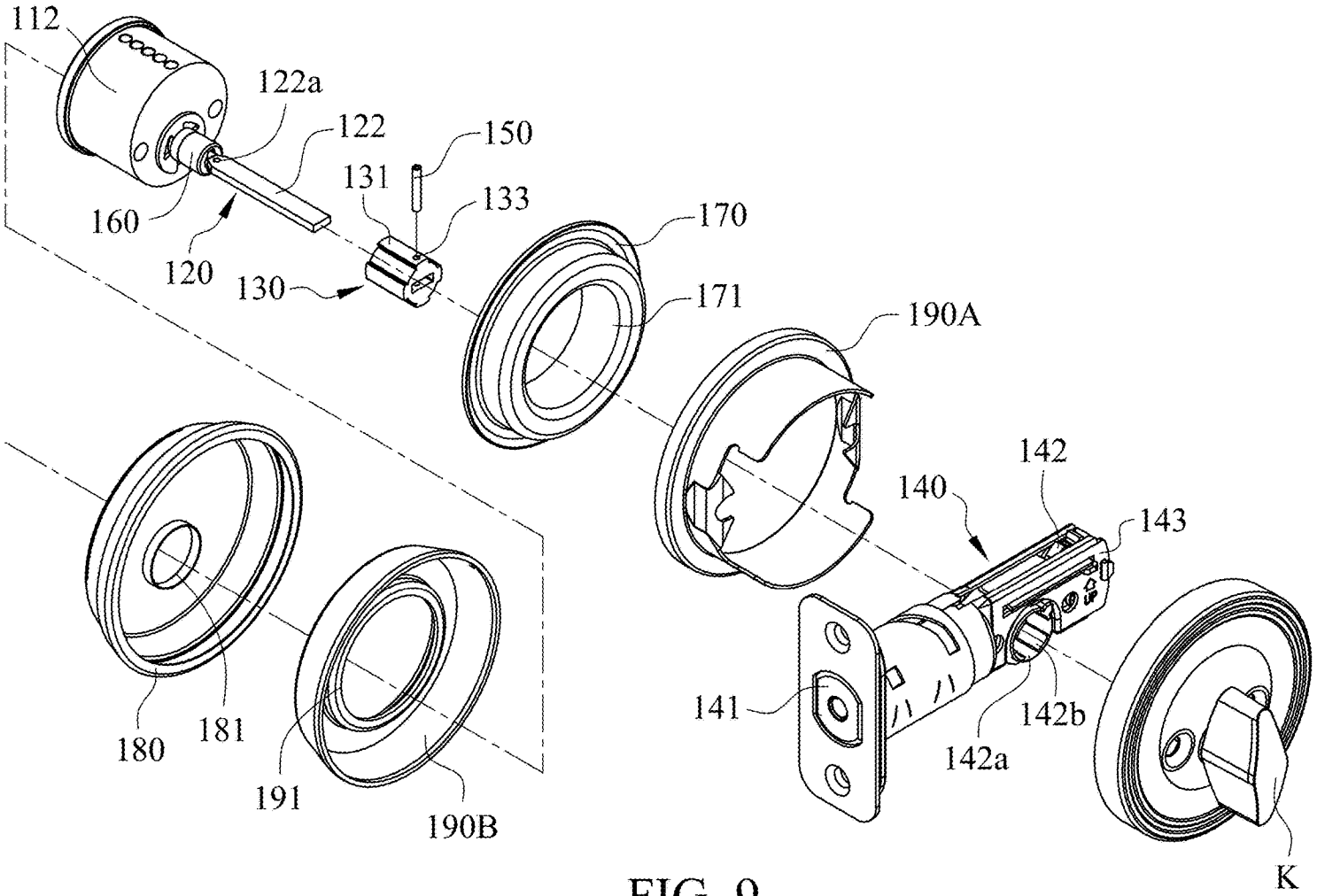
FIG. 9 is a perspective exploded diagram illustrating a lock mechanism in accordance with a second embodiment of the present invention.

With reference to FIG. 9, the diagram represents a second embodiment of the present invention, and the difference between the first and second embodiments is the shape of the interior lid 190A.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A lock mechanism comprising:

a plug assembly having a plug, the plug includes a first coupling end portion;

a transmission spindle having a second coupling end portion and a transmission portion, the second coupling end portion is coupled with the first coupling end portion to allow the plug to drive the transmission spindle rotate;

a bush covering the first coupling end portion and the second coupling end portion, the bush and the transmission spindle are coupled with each other and rotate together; and a latchbolt assembly having a latchbolt and an actuation element, the actuation element has an actuation hole and the bush is movably accommodated in the actuation hole, wherein the bush is provided to move the actuation element in swinging movement to actuate operation of the latchbolt.

2. The lock mechanism in accordance with claim 1, wherein the plug assembly includes a cylinder, the plug is disposed in the cylinder and the first coupling end portion is protruded from the cylinder.

3. The lock mechanism in accordance with claim 1, wherein the bush includes at least one actuation convex and the actuation element includes at least one pushed convex in the actuation hole, and wherein the actuation convex is provided to push the pushed convex to allow the bush to move the actuation element in swinging movement.

4. The lock mechanism in accordance with claim 1, wherein the bush has a horizontal through hole, and the transmission portion is assembled through the horizontal through hole of the bush and protruded from the actuation hole of the actuation element.

5. The lock mechanism in accordance with claim 4 further comprising a coupling element, wherein the bush has a vertical through hole communicating with the horizontal through hole and the transmission portion has a coupling hole, and wherein the coupling element is assembled through the vertical through hole and the coupling hole for coupling the bush and the transmission spindle as one piece.

6. The lock mechanism in accordance with claim 4, wherein the first coupling end portion and the second coupling end portion are accommodated in the horizontal through hole of the bush.

7. The lock mechanism in accordance with claim 4 further comprising a cover covering the first coupling end portion and the second coupling end portion, wherein the cover is coupled to the first coupling end portion and accommodated in the horizontal through hole of the bush.

8. The lock mechanism in accordance with claim 1 further comprising a fixing plate and a first escutcheon, wherein the fixing plate includes a fixing base and the plug assembly is disposed in the fixing base, and wherein the first escutcheon covers the fixing plate and has a first opening revealing the plug.

9. The lock mechanism in accordance with claim 8 further comprising a second escutcheon located between the first escutcheon and the fixing plate, wherein the second escutcheon covers the fixing plate and has a second opening revealing the cylinder and the plug.

10. The lock mechanism in accordance with claim 9 further comprising an interior lid, wherein the interior lid covers the second escutcheon and the fixing plate is located between the interior lid and the second escutcheon.

* * * * *